US009982371B2

(12) United States Patent
Clarren et al.

(10) Patent No.: US 9,982,371 B2
(45) **Date of Patent: *May 29, 2018**

(54) SCREEN WITH VISIBLE MARKER

(71) Applicant: Aedes Technologies, Seattle, WA (US)

(72) Inventors: Sterling Clarren, Seattle, WA (US); Jonathan Seth Clarren, Seattle, WA (US); Dena Pomaikai Molnar, Somerville, MA (US)

(73) Assignee: AEDES TECHNOLOGIES, Seattle, WA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/930,205

(22) Filed: Nov. 2, 2015

(65) Prior Publication Data

US 2016/0053414 A1 Feb. 25, 2016

Related U.S. Application Data

(63) Continuation of application No. 13/841,057, filed on Mar. 15, 2013, now Pat. No. 9,175,509.

(51) Int. Cl.

| | |
|---|---|
| ***E06B 9/24*** | (2006.01) |
| ***D03D 13/00*** | (2006.01) |
| ***D03D 1/00*** | (2006.01) |
| ***D03D 9/00*** | (2006.01) |
| ***E06B 9/52*** | (2006.01) |

(52) U.S. Cl.

CPC ..... *D03D 13/004* (2013.01); *D03D 1/007* (2013.01); *D03D 1/0017* (2013.01); *D03D 9/00* (2013.01); *D03D 13/008* (2013.01); *E06B 9/24* (2013.01); *E06B 9/52* (2013.01); *D10B 2101/06* (2013.01); *D10B 2101/20* (2013.01); *D10B 2503/00* (2013.01); *E06B 2009/2405* (2013.01); *E06B 2009/524* (2013.01)

(58) Field of Classification Search

CPC ..... E06B 9/24; E06B 2009/2405
USPC ..... 160/350, 351, 371, DIG. 7; 442/181; 139/383 R, 417, 419

See application file for complete search history.

(56) References Cited

U.S. PATENT DOCUMENTS

| | | | |
|---|---|---|---|
| 416,225 | A | 12/1889 | Kerr |
| 1,775,144 | A | 9/1930 | Sherman |
| 1,786,781 | A | 12/1930 | Shoemaker |
| 1,817,716 | A | 8/1931 | Stam |
| 1,919,481 | A | 7/1933 | Rowell |
| 2,021,993 | A | 11/1935 | Gutlon |
| 2,037,629 | A | 4/1936 | Holgate |
| 2,065,309 | A | 12/1936 | Hamer |
| 2,093,187 | A | 9/1937 | Burke et al. |
| 2,281,635 | A | 5/1942 | Strauss |
| 2,297,729 | A | 10/1942 | Thomas |

(Continued)

OTHER PUBLICATIONS

Invoice; Invoice No. 90375249; Phifer Incorporated; Nov. 2007.

*Primary Examiner* — Katherine W Mitchell
*Assistant Examiner* — Johnnie A. Shablack

(57) ABSTRACT

Products and devices are described for displaying a visible marker on a screen. Some embodiments disclose using different weave patterns and/or density patterns to create the visible marker. Other embodiments disclose using different colors of thread to create the visible marker. The present disclosure also describes methods for manufacturing or displaying the visible marker on the screen.

6 Claims, 13 Drawing Sheets

(56) References Cited

U.S. PATENT DOCUMENTS

| | | | | |
|---|---|---|---|---|
| RE23,603 | E | 12/1952 | Rohs | |
| 3,417,794 | A | 12/1968 | Lynch et al. | |
| 3,434,510 | A | 3/1969 | Neyert | |
| 3,696,845 | A | 10/1972 | Acker et al. | |
| 4,002,188 | A | 1/1977 | Hanks | |
| 4,197,345 | A | 4/1980 | Worrall | |
| 4,587,997 | A | 5/1986 | Brooks | |
| 4,848,412 | A | 7/1989 | Pittman et al. | |
| 5,139,076 | A | 8/1992 | Langdon | |
| 5,400,848 | A | 3/1995 | Gainer | |
| 5,680,893 | A | 10/1997 | Neer | |
| 5,727,600 | A | 3/1998 | Musha et al. | |
| 5,728,632 | A | 3/1998 | Sugie | |
| 5,758,697 | A | 6/1998 | Musha et al. | |
| 5,983,952 | A | 11/1999 | Carpenter et al. | |
| 6,042,912 | A | 3/2000 | Simoni | |
| 6,105,276 | A | 8/2000 | Ensign et al. | |
| 6,123,117 | A | 9/2000 | Borellini | |
| 6,283,166 | B1 | 9/2001 | Miyasato et al. | |
| 6,378,567 | B1 | 4/2002 | Chen | |
| 6,397,920 | B1 | 6/2002 | Forin | |
| 6,672,361 | B2 | 1/2004 | Fransen | |
| 6,763,855 | B2 | 7/2004 | Rougvie | |
| 6,836,907 | B1 | 1/2005 | Pesta | |
| 6,995,099 | B1 | 2/2006 | Nishimura et al. | |
| 7,059,381 | B2 | 6/2006 | Chen | |
| 7,172,802 | B2 | 2/2007 | Sutherland et al. | |
| 7,192,633 | B2 | 3/2007 | Fransen | |
| 7,997,035 | B2 | 8/2011 | Weaver | |
| 8,042,598 | B2 * | 10/2011 | Bredemus | E06B 9/52 160/371 |
| 8,614,156 | B2 | 12/2013 | Hess et al. | |
| 9,175,509 | B2 * | 11/2015 | Clarren | E06B 9/24 |
| 2006/0166577 | A1 | 7/2006 | Rashed | |
| 2006/0169347 | A1 | 8/2006 | Wahhoud | |
| 2007/0089842 | A1 | 4/2007 | Hanni | |
| 2007/0286982 | A1 | 12/2007 | Higgins et al. | |
| 2008/0006375 | A1 | 1/2008 | Meadows | |
| 2008/0006376 | A1 * | 1/2008 | Bredemus | D03D 9/00 160/371 |
| 2009/0173454 | A1 | 7/2009 | Cheng | |
| 2010/0285274 | A1 | 11/2010 | Fukunaga | |
| 2011/0159757 | A1 | 6/2011 | Percival | |
| 2011/0268921 | A1 | 11/2011 | Canales et al. | |
| 2011/0315303 | A1 | 12/2011 | Bird | |
| 2012/0037263 | A1 | 2/2012 | Malloy | |
| 2012/0102707 | A1 | 5/2012 | Chen | |
| 2012/0103540 | A1 | 5/2012 | Shaffer et al. | |
| 2012/0160432 | A1 | 6/2012 | Griggio et al. | |
| 2013/0180169 | A1 | 7/2013 | Toye | |
| 2013/0260629 | A1 | 10/2013 | Dua et al. | |
| 2013/0276996 | A1 | 10/2013 | Huang et al. | |
| 2013/0312155 | A1 | 11/2013 | Tone et al. | |
| 2014/0220846 | A1 | 8/2014 | Woodruff et al. | |
| 2014/0290160 | A1 * | 10/2014 | Altieri, Jr. | E06B 7/02 52/203 |
| 2014/0290880 | A1 * | 10/2014 | Altieri, Jr. | E06B 9/521 160/369 |
| 2014/0345811 | A1 | 11/2014 | McDaniel | |
| 2016/0053414 | A1 * | 2/2016 | Clarren | E06B 9/24 139/416 |
| 2016/0069003 | A1 * | 3/2016 | Molnar | D03D 51/007 700/140 |

* cited by examiner

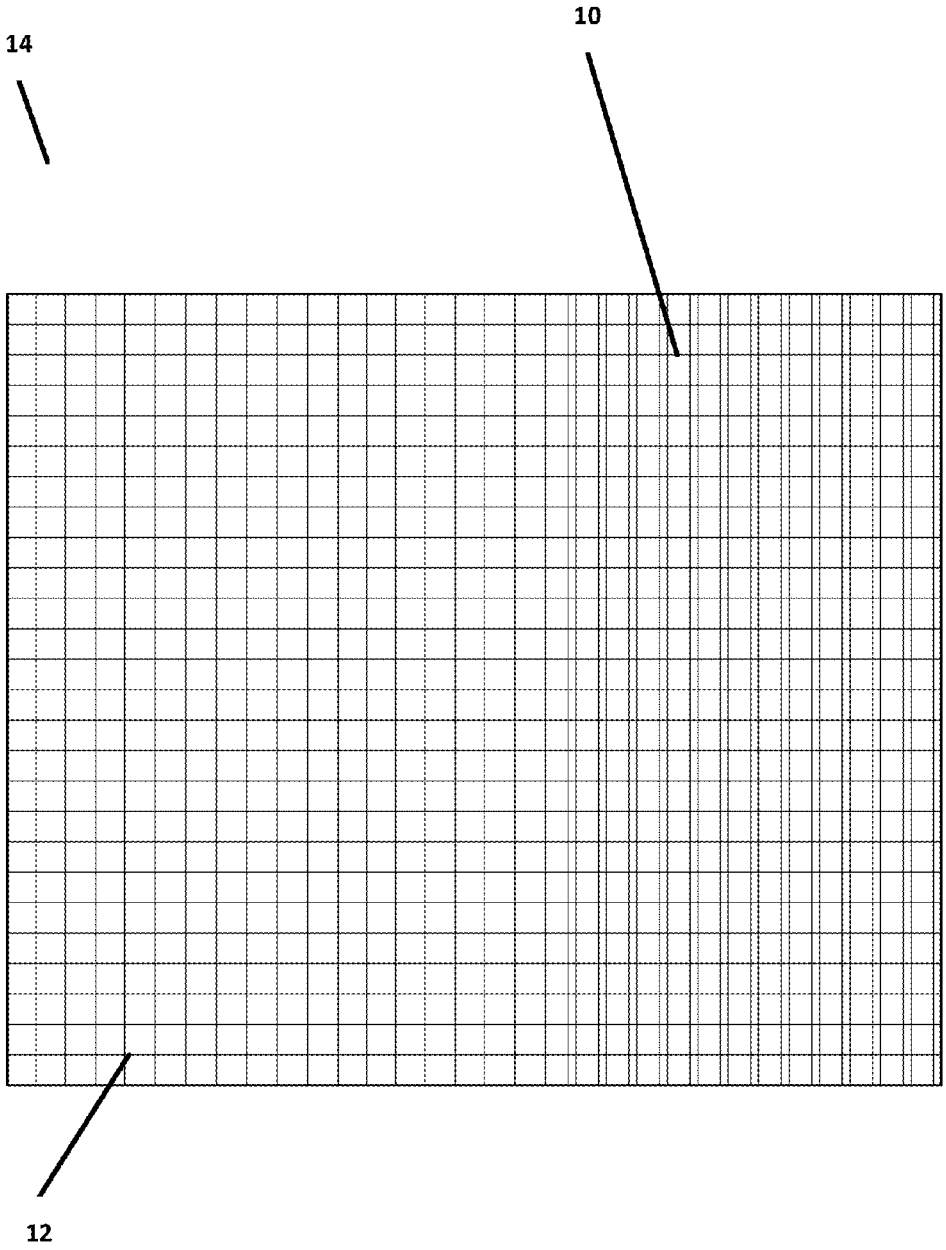
FIG. 4B
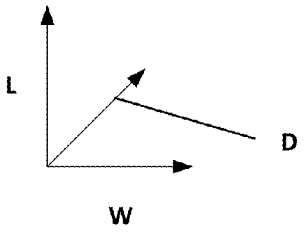

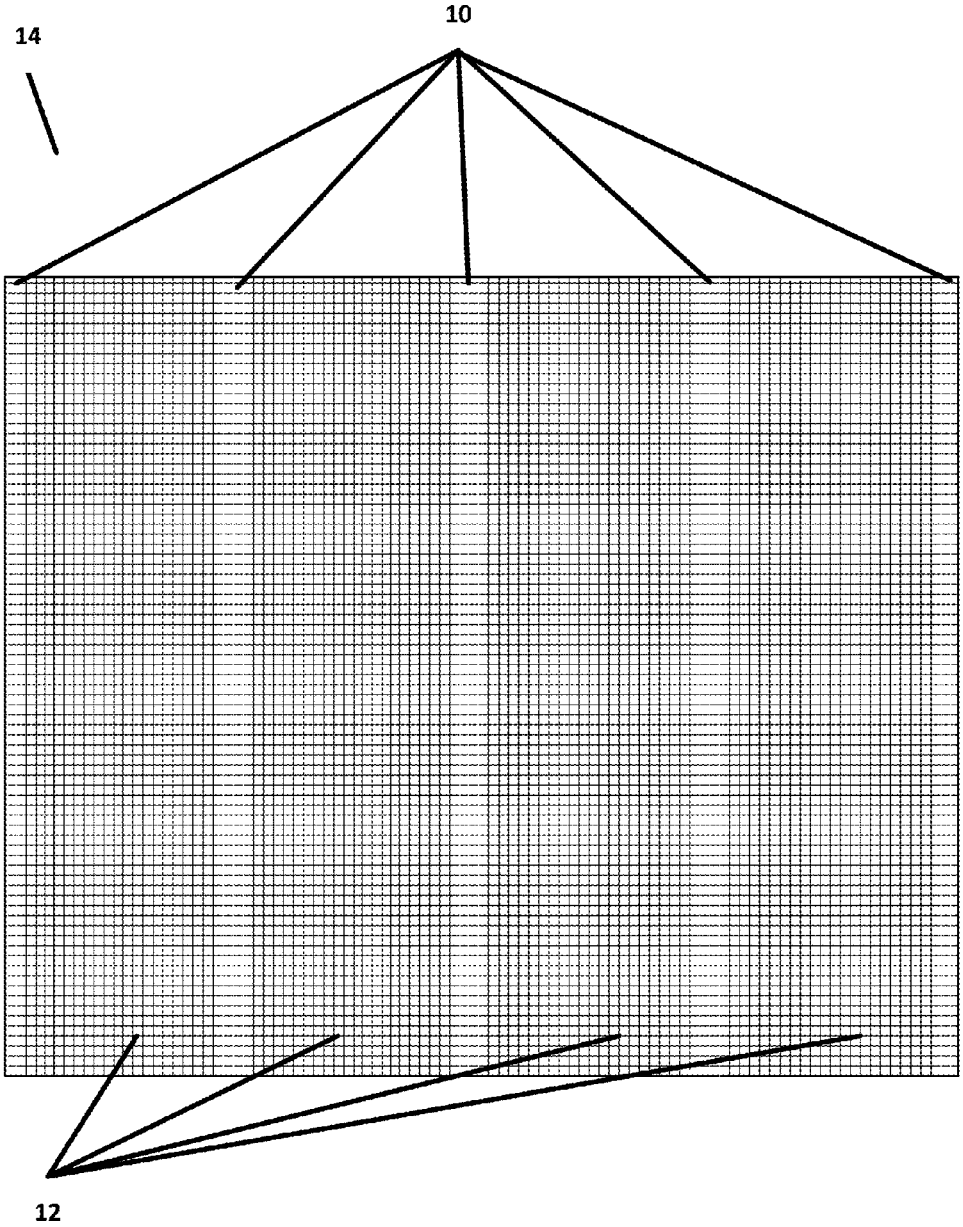
FIG. 5A
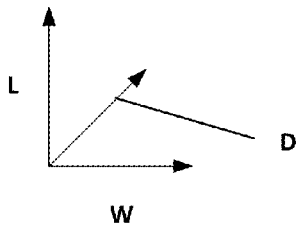

SCREEN WITH VISIBLE MARKER

CROSS REFERENCE TO RELATED APPLICATIONS

This application is a continuation of U.S. patent application Ser. No. 13/841,057, filed Mar. 15, 2013, the entire contents of which are incorporated by reference.

BACKGROUND

Screen doors and windows are traditionally used to enclose an interior space. The screen material allows the exterior air to pass through the screen into the interior space, while also preventing debris, insects and other undesirable objects from entering the interior space. However, screen doors and windows can be difficult to see, which can result in people and animals walking into them. This can be a hazard that results in injury to the person or animal and damage to the screen door or window.

SUMMARY

In general, this disclosure describes products, systems, and techniques for providing an indication to a user of the presence of a screen. In some examples described herein, the screen is configured to display a visible marker that can provide a visual indication to the user that the screen is present. In some embodiments, the screen may be mounted to a door or window. However, it should be appreciated that this screen may be used in any configuration where visual detection of a screen may be beneficial.

In one embodiment, a screen product may comprise a frame that defines an exterior portion and a screen removably received by the frame. The screen includes a longitudinal thread that extends along a first direction and a widthwise thread that extends along a second direction that is perpendicular to the first direction. The longitudinal thread and the widthwise thread are weaved to form a mesh. The mesh includes a first pattern configured to achieve a first transparency and a second pattern configured to achieve a second transparency.

In another embodiment, a screen product may be adapted to enclose a space to protect a space from debris. The screen may also be adapted to display a first pattern that is configured to provide a first transparency. Additionally, the screen may be adapted to display a second pattern that is configured to provide a second transparency. A user may be able to visually detect the presence of the screen product based on the second pattern.

In another embodiment, a screen may be configured to be removably received by a frame. The screen may include a longitudinal thread that extends along a first direction and a widthwise thread that extends along a second direction that is perpendicular to the first direction. The longitudinal thread and the widthwise thread are weaved to form a mesh. The mesh includes a first pattern configured to achieve a first transparency and a second pattern configured to achieve a second transparency.

In yet another embodiment, the disclosure includes a method of manufacturing a screen product. The screen product includes a longitudinal thread that extends along a first direction and a widthwise thread that extends along a second direction that is perpendicular to the first direction. The method includes weaving the longitudinal thread and the widthwise thread to form a mesh. The method also includes configuring the mesh to form a first pattern configured to achieve a first transparency and a second pattern configured to achieve a second transparency.

The details of one or more embodiments are set forth in the accompanying drawings and the description below. Other features, objects, and advantages of the disclosed embodiments will be apparent from the description and drawings, and from the claims.

BRIEF DESCRIPTION OF THE DRAWINGS

The foregoing summary, as well as the following detailed description of various embodiments, is better understood when read in conjunction with the appended drawings. For the purposes of illustration, specific embodiments were selected to be shown; however, the present disclosure is not limited to the specific methods and instrumentalities disclosed herein. In the drawings:

FIG. 4B illustrates a close-up view of the screen from FIG. 4A focusing on the visible marker abutting a ground pattern;

FIG. 5A illustrates a front-view of another embodiment of a screen with visible markers positioned at various locations on the screen;

DETAILED DESCRIPTION OF ILLUSTRATIVE EMBODIMENTS

Techniques for improving visibility of screens are described herein. Specific details of embodiments of the present disclosure are set forth in the following description and in FIGS. 1-8. Certain well-known technology details are not set forth in the following description to avoid unnecessarily obscuring the various embodiments. Those of ordinary skill in the relevant art will understand that they can practice other embodiments of the disclosure without departing from the scope of the subject matter presented herein.

Residential and commercial structures often have screens that are mounted to the exterior of the structure. The screens are typically used to serve several purposes. One purpose might be to prevent unwanted debris, such as insects, leaves, etc. from entering an interior portion of the structure. A second purpose might be to allow exterior air to enter the interior portion of the structure. In this manner, the screen may allow the desirable features of an outdoor environment to enter the interior portion of the structure. It should also be appreciated that screens may be used in interior portions of structures for many purposes that will be discussed herein.

In some embodiments, screens may comprise a mesh interface. The mesh interface may not only serve the functions as previously described, but the mesh interface may also allow a user to see through the screen to visually detect the outdoor environment or the environment beyond the screen. The user includes, but is not limited to, any human being, animal, or any other living being capable of detecting light and converting light into electro-chemical impulses in neurons. Because the mesh may be configured to have a nearly invisible appearance, the screen may be difficult to visually detect by the user. In this manner, the user may inadvertently contact the screen, which can cause harm or injury to the user and damage to the screen. It would be useful to have a screen with a visible marker to provide notification to the user of the screen's presence.

Figure 1:
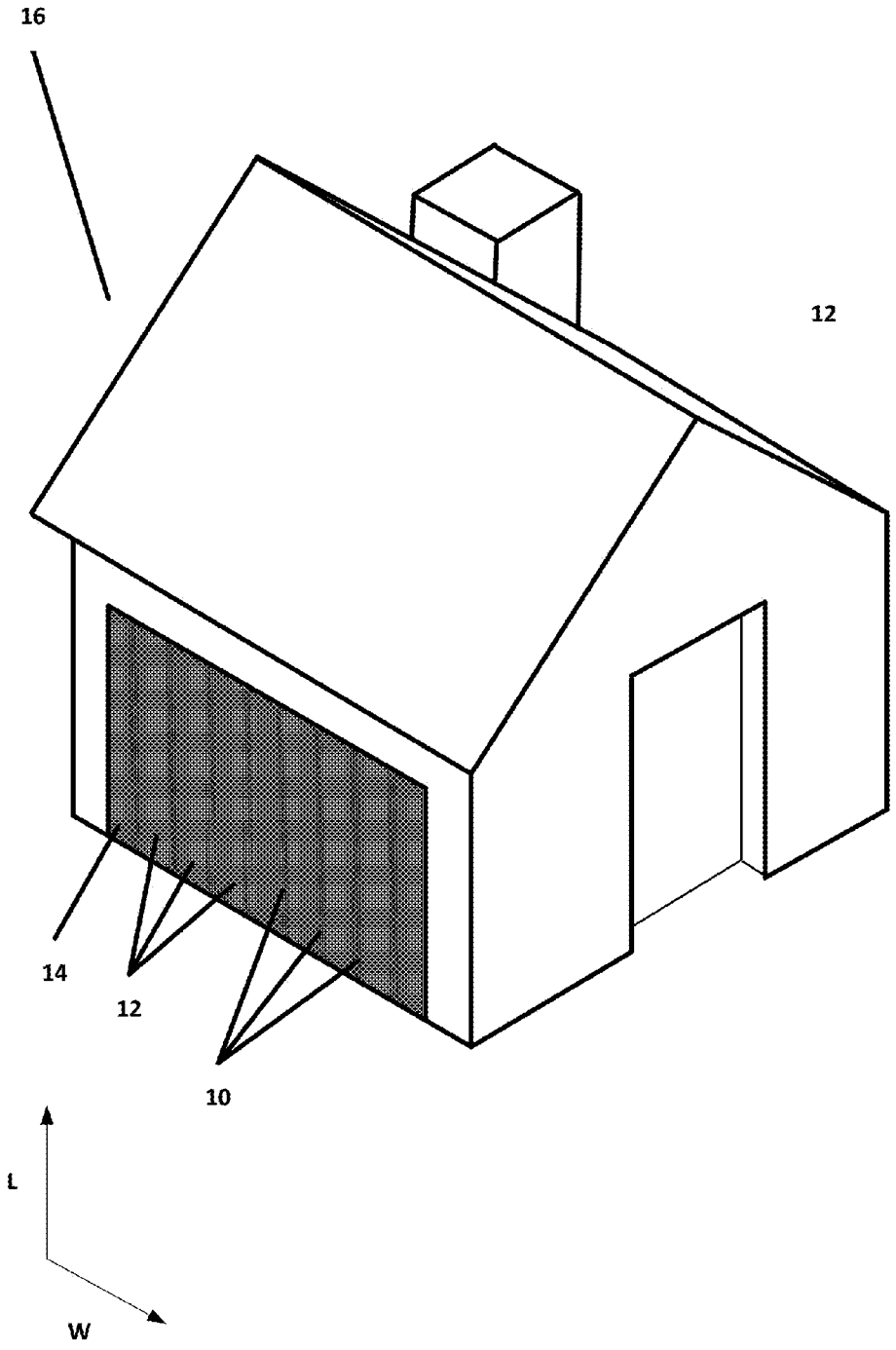
FIG. 1 illustrates a perspective view of a structure that is partially enclosed with screens displaying visible markers.

FIG. 1 shows a perspective view of a structure 16 that is partially enclosed by a screen 14. Screen 14 may further include one or more ground patterns 12 and one or more visible markers 10, which may be configured to be visible to a user so that the presence of the screen can be determined. In the embodiment as shown in FIG. 1, screen 14 is mounted along the exterior portion of the structure 16. Specifically, in the embodiment shown in FIG. 1, screen 14 may be configured to be removably mounted to a door and/or window frame. Screen 14 may further be configured to display one or more visible markers 10 and one or more ground patterns 12. In this manner, ground pattern 12 defines a first pattern that is configured to achieve a first transparency. As well, visible marker 10 defines a second pattern configured to achieve a second transparency. The second transparency may be configured to be more visible to the user and in effect, it may be easier to visually detect the overall presence of the screen 14 by the user. In addition, the second transparency may also be easier to visually detect by the user because the second transparency may create a visible contrast when positioned adjacent to the first transparency.

It should be appreciated that the structure 16 is not limited to the structure as disclosed in FIG. 1. In other embodiments, the structure 16 may be, but is not limited to any of the following: a commercial structure; an industrial structure; a temporary structure, such as a tent or shelter; a storage structure, such as a shed; an outdoor feature, such as a pergola, arbor, windbreak for vegetation, or plant covering; an automobile; a batting cage; or any other structure that is at least partially enclosed by a screen or contains at least a portion of a screen within the interior.

In addition to screen 14 partially enclosing a structure, there are many other applications. Screen 14 may be used along any interior or exterior portion of any of the previously mentioned structures or contemplated structures. For example, screen 14 may be a fire screen that is positioned in front of a fireplace. In other embodiments, screen 14 may be a folding screen, such as a Japanese decorative folding screen. In other embodiments, screen 14 may cover a windshield of an automobile. In other embodiments, screen 14 may be used in a confessional to separate a priest from a penitent. In yet other embodiments, screen 14 may be a smoke screen. In still other embodiments, screen 14 may be used along any interior or exterior portion of a tent. In general, it should be appreciated that the screen 14 may be used in any application within the interior or exterior of any structure where it may be beneficial to alert the user of the presence of the screen 14.

Furthermore, the embodiment in FIG. 1 shows the screen 14 as partially enclosing the structure 16. In other embodiments, the screen 14 may completely enclose the structure 16. In addition, it should also be appreciated that the screen 14 may be positioned at any location on the structure 16. In some embodiments, one or more screens 14 may be positioned at a top portion of the structure 16 along the first direction L. For example, the structure 16 may have one or more screens 14 along the roof of the structure 16 serving as skylights. In this manner, the screen 14 may be configured to have one or more visible markers 10, which may alert a bird or any other living being of the presence of the screen.

Figure 2:
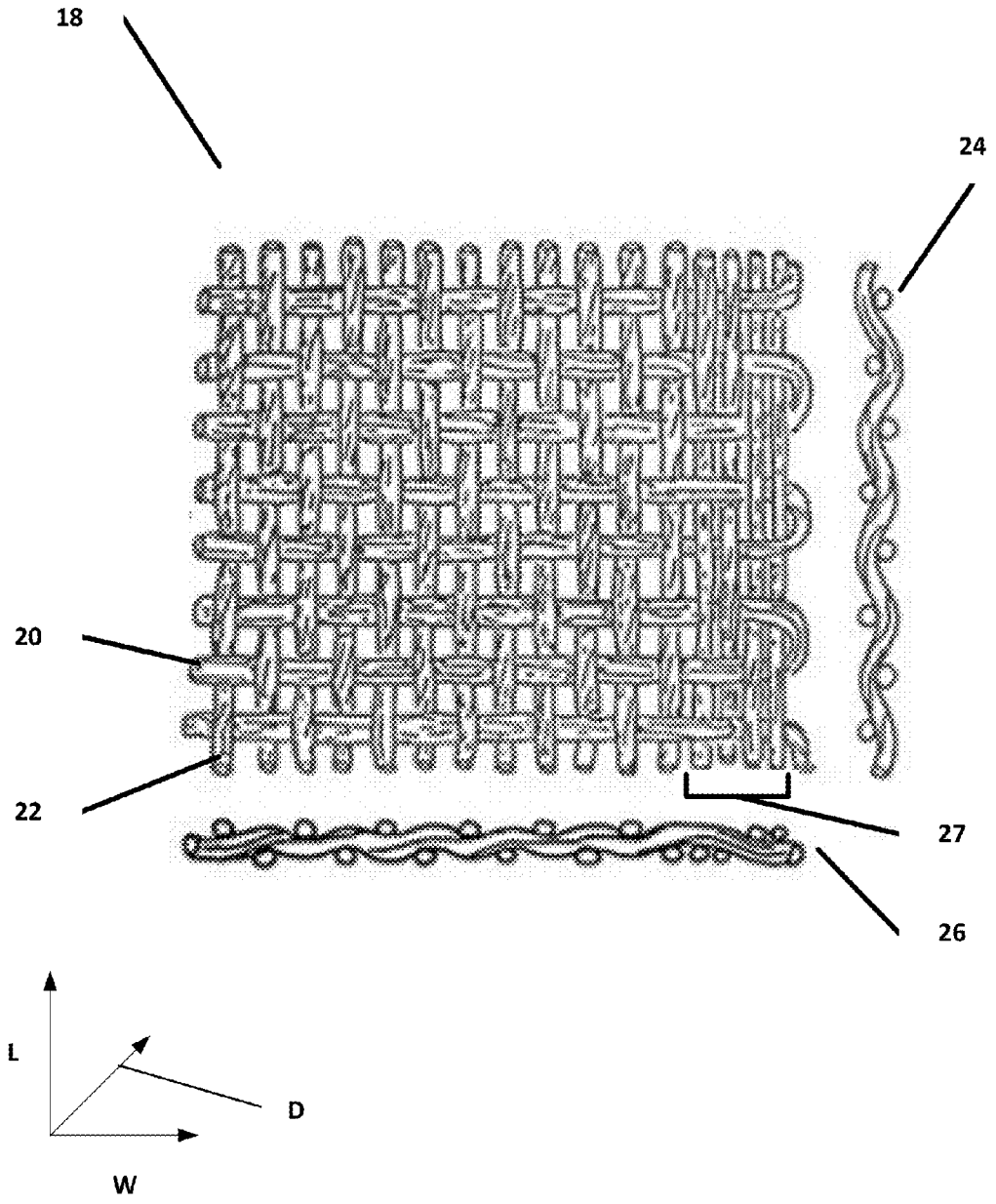
FIG. 2 illustrates a top-down view of plain weave pattern.

FIG. 2 illustrates a plain weave, which is a type of mesh pattern that may be used in the screen 14 that further defines the visible marker 10 and ground pattern 12. FIG. 2 shows plain weave 18, as further including filling threads 20, warp threads 22, filling cross section 24, warp cross section 26, and selvage 27. In the embodiment shown in FIG. 2, filling 20, also known as weft, may be a thread or any suitable material that runs horizontal or widthwise along a second direction W. One thread of filling 20 may be known as a pick. In FIG. 2, warp threads 22 may be the thread that runs vertical or longitudinal along a first direction L. Accordingly, one warp thread 22 may be known as an end. In the plain weave embodiment shown in FIG. 2, one repeat of a plain weave may be comprised of two ends and two picks.

It should also be appreciated that the filling threads 20 and warp threads 22 may extend along other directions besides first and second directions L and W. In some embodiments, the warp threads 22 extend along a third direction D (as shown in FIG. 2). The third direction D may extend in any direction along the 90° between first and second directions L and W. In these embodiments, the filling threads 20 may extend perpendicular to the third direction D. In this manner, the threads of the screen 14 may be configured in any direction (L, W, or D).

While thread is described above, it should be appreciated that any type of suitable material that is able to be threaded to form a pattern may be used. For example, the thread may be made from a material comprising stainless steel, vinyl coated fiberglass yarn, or fiberglass. It should also be appreciated that any size of thread material may be used to form the mesh of screen 14. In some embodiments, the thread is 0.006 inches (0.01524 centimeters) to 0.011 inches (0.02794 centimeters) in diameter. It should also be appreciated that the term thread can refer to monofilament, single ply, plied, and textured yarn.

While FIG. 2 illustrates a plain weave embodiment, it should be noted that this is only one type of many weaves that may be used to configure screen 14, visible marker 10, and ground pattern 12. It should be appreciated that any of the following types of weaves may be used, such as a crepe weave, rib weave, matt weave, basket weave, twill weave, satin weave, or any type of weave that is able to be configured to visually alert a user of the presence of the screen. For example, a crepe weave can be configured such that there is no repeat pattern and instead is a random pattern that can be reversible.

It should also be appreciated that the person having ordinary skill in the art may also refer to the first and second transparencies as the first and second cover factors. The first and second cover factors may be defined by a measurement of the percentage area covered by the material. The cover factor may depend upon the textile or fabric construction and the cover factor may change depending on material density, the type of weave pattern, and the profile of the material. To further illustrate cover factor, patterns with a low cover factor may have a high percentage of open area, which may make them more difficult to visually detect by the user. In accordance, patterns with a high cover factor may have a low percentage of open area, which may make them less difficult to visually detect by the user.

Figure 3A:
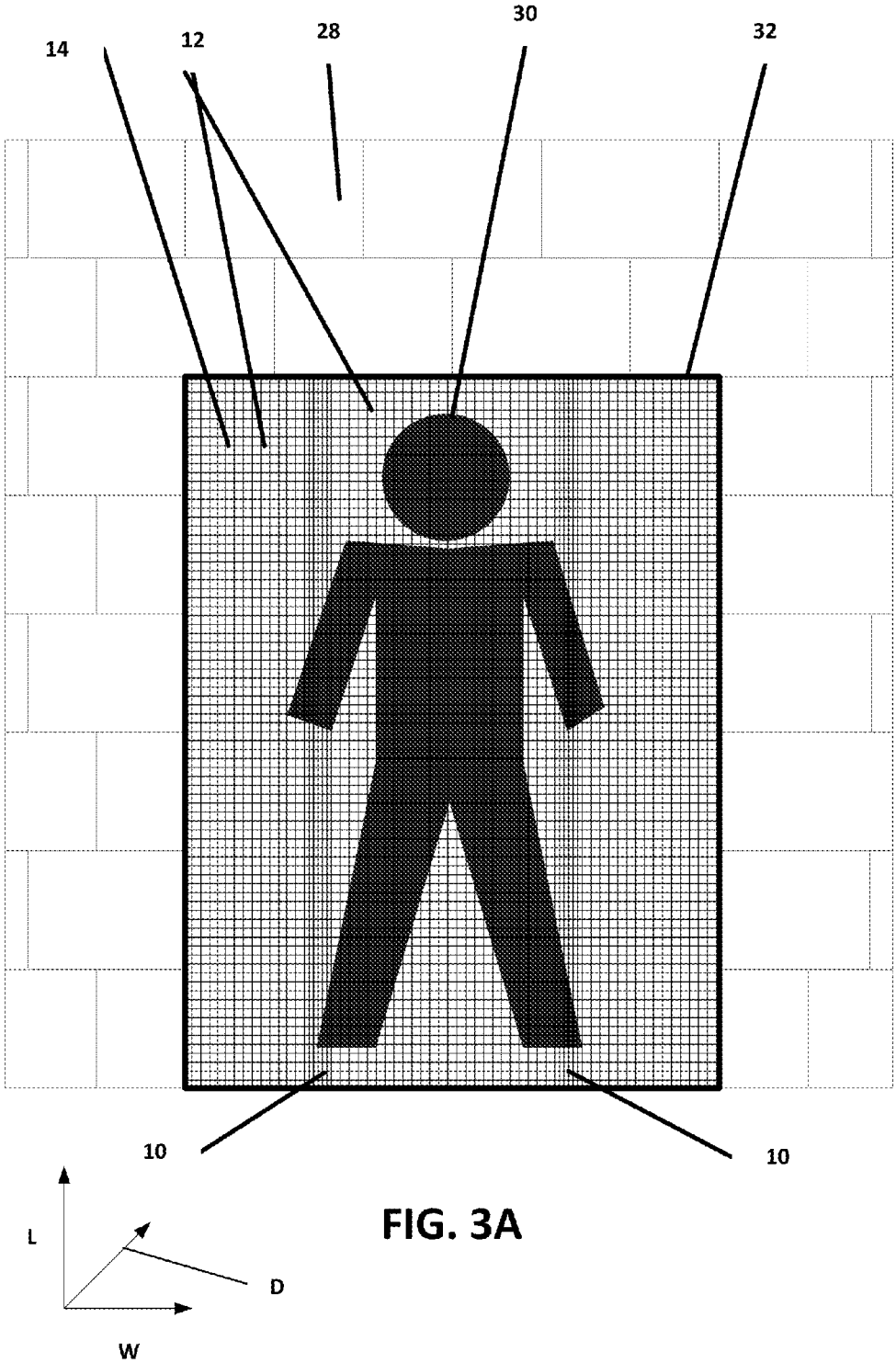
FIG. 3A illustrates an embodiment of a screen displaying visible markers and a user standing on one side of the screen.

FIG. 3A illustrates an embodiment of a screened enclosure 32 that is mounted to an exterior portion of wall 28. Screened enclosure 32 may define a frame that further defines an exterior portion of the screened enclosure 32. Screened enclosure 32 may further comprise a screen 14 that is removably received by the frame. The screen 14 may comprise both longitudinal and widthwise threads. The longitudinal thread may extend along a first direction L and the widthwise thread may extend along a second direction W that is perpendicular to the first direction. The longitudinal and widthwise threads may be weaved to form a mesh that includes a first pattern (or ground pattern 12) and a second pattern (or visible marker 10).

The ground pattern 12 may be configured to achieve a first transparency, and the visible marker 10 may be configured to achieve a second transparency that extends along the first direction L. In the embodiment illustrated in FIG. 3A, the first transparency may be achieved by a ground pattern 12 using a thread that is dark in color, such as black, gray, charcoal, or any color that is not white (or light in value). The second transparency may be achieved by a pattern of the visible marker 10 that uses an increased number of warp threads 22, with respect to the ground pattern 12. Furthermore, the warp threads 22 may also be the same color thread as those used in the ground pattern 12. In some embodiments, the increased number of warp threads 22 that defines the second transparency is twice the number of warp threads 22 that defines the first transparency. In other words, the ratio of the warp threads 22 between the second and first transparencies may be 2:1. In other embodiments, the ratio is any ratio above 1:1.

The ratio may also be described as density. The density may be measured by the number of longitudinal threads per inch (ends/inch). In this manner, the density of the second transparency may be greater than the density of the first transparency. In one embodiment of the screen 14, the visible marker 10 may have a density that is 36 ends/inch (91.44 ends/centimeter) and the ground pattern may have a density that is 18 ends/inch (45.72 ends/centimeter). The mesh may further be defined by the number of widthwise threads per inch (picks/inch). In one embodiment, the mesh has 16 picks/inch (40.64 picks/centimeters). It should be appreciated that the mesh may have any density of longitudinal threads/inch (ends/inch) and widthwise threads/inch (picks/inch).

First and second transparencies may be configured to have different transparencies with respect to each other. In this manner, the user 30 may be able to visually detect screen 14. This visible detection may be achieved because the second transparency is configured to be more visible than the first transparency. In this manner, the second transparency may visually alert user 30 to the presence of the screen 14. In addition, by configuring the second transparency adjacent to the first transparency, this may create a visible contrast that may increase visible detection as opposed to screen 14 being configured to only display one transparency across the entire screen 14.

Figure 3B:
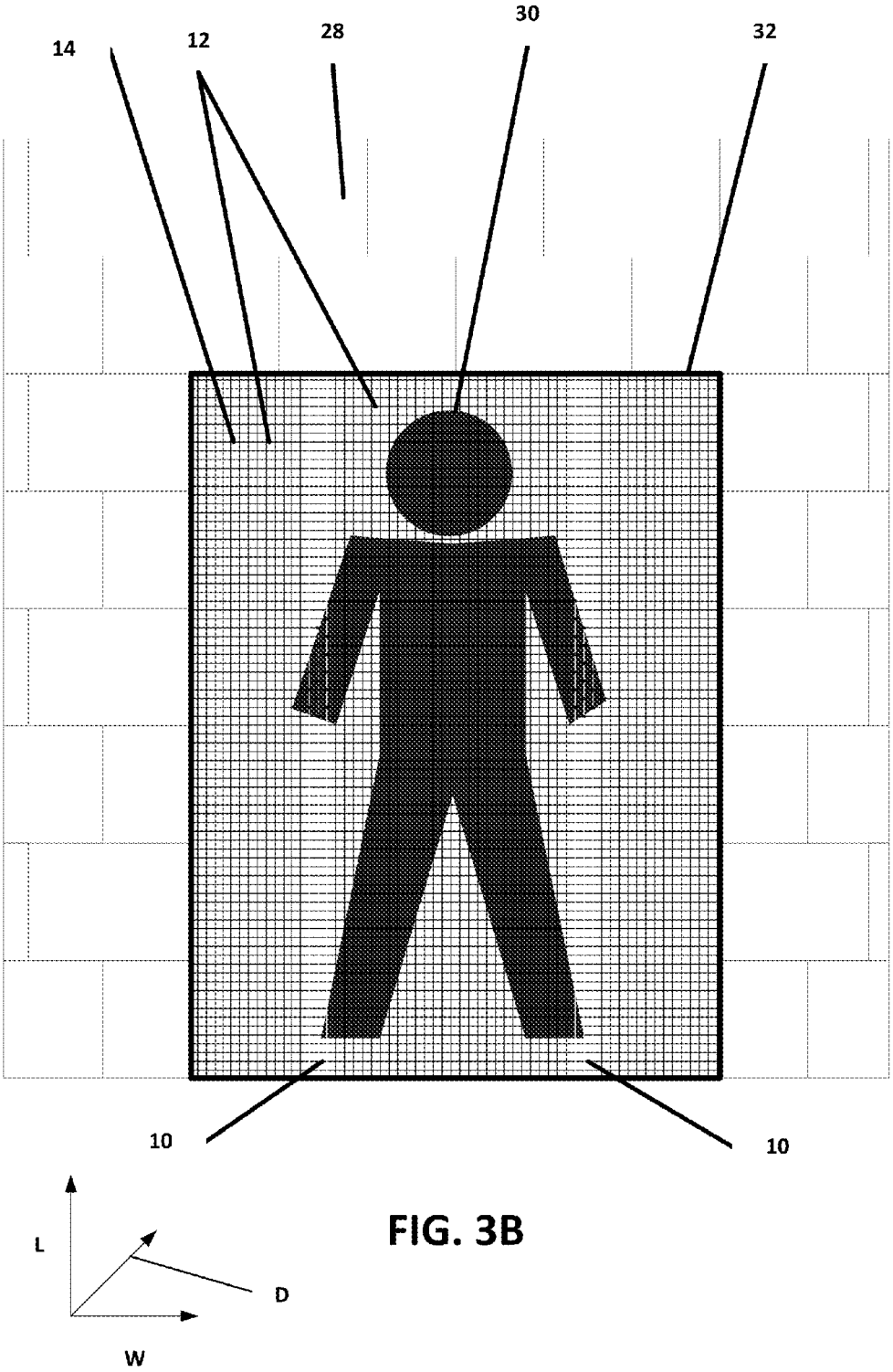
FIG. 3B illustrates another embodiment of a screen displaying visible markers and a user standing on one side of the screen.

FIG. 3B illustrates another embodiment of a screened enclosure 32 that is mounted to an exterior portion of wall 28. In this embodiment, the screened enclosure is the same as the embodiment shown in FIG. 3A, with the following differences. In the embodiment of FIG. 3B, the ratio of the warp threads 22 of the second transparency to the first transparency may be 1:1. Furthermore, the visible marker 10 that defines the second transparency, as shown in FIG. 3B, may be achieved by configuring a portion of the warp threads 22 in the visible marker 10 to be a different color than the warp threads 22 in the ground pattern 12 that defines the first transparency. As such, the color of the warp threads 22 that defines the second transparency may be any color (or value) thread that is a different color (or value) than the warp threads 22 that defines the first transparency. In some embodiments, the warp threads 22 that define the second transparency may be white. It should also be appreciated that the may be any ratio above or below 1:1.

Figure 3C:
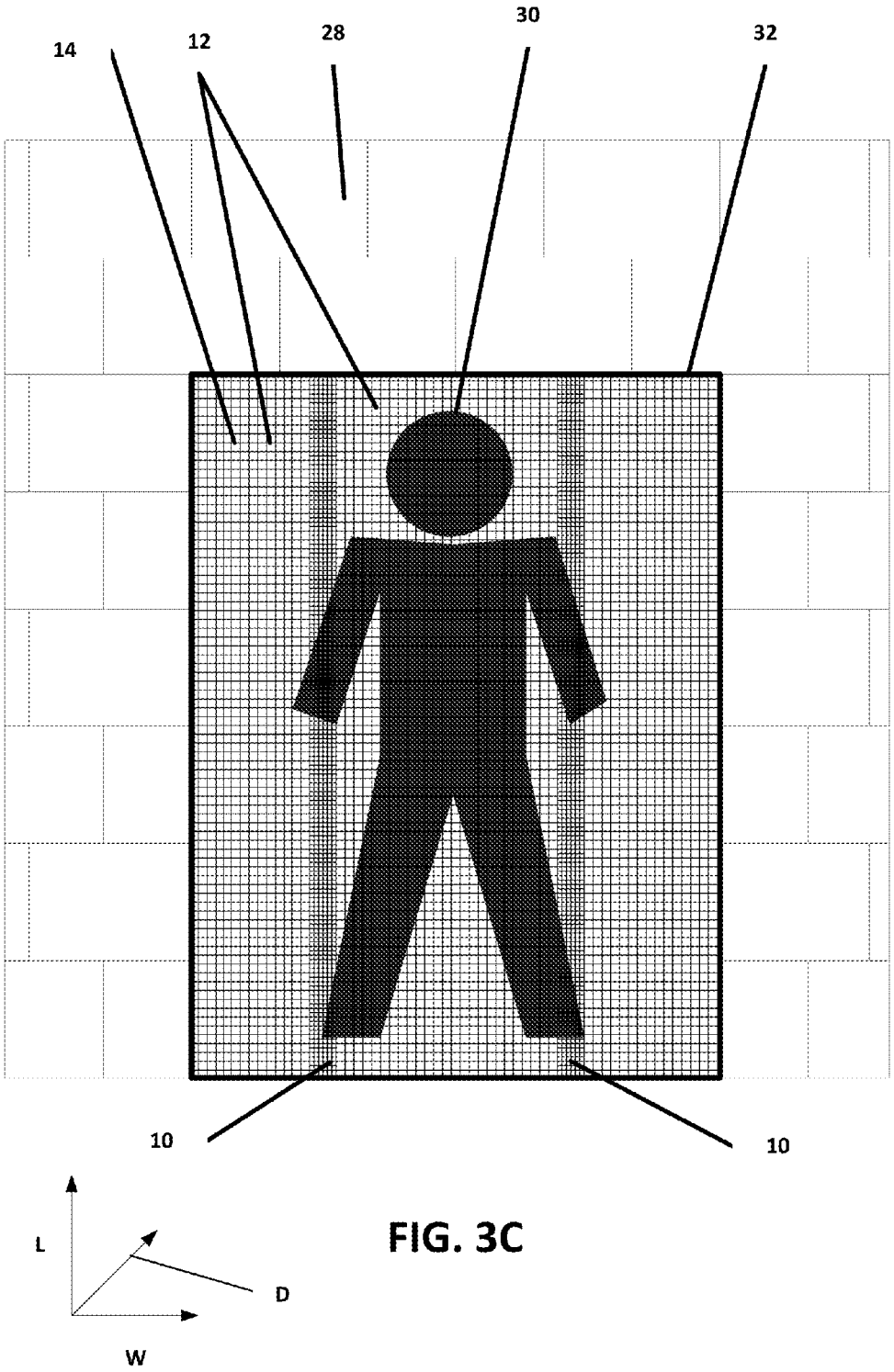
FIG. 3C illustrates another embodiment of a screen displaying visible markers and a user standing on one side of the screen.
Figure 8:
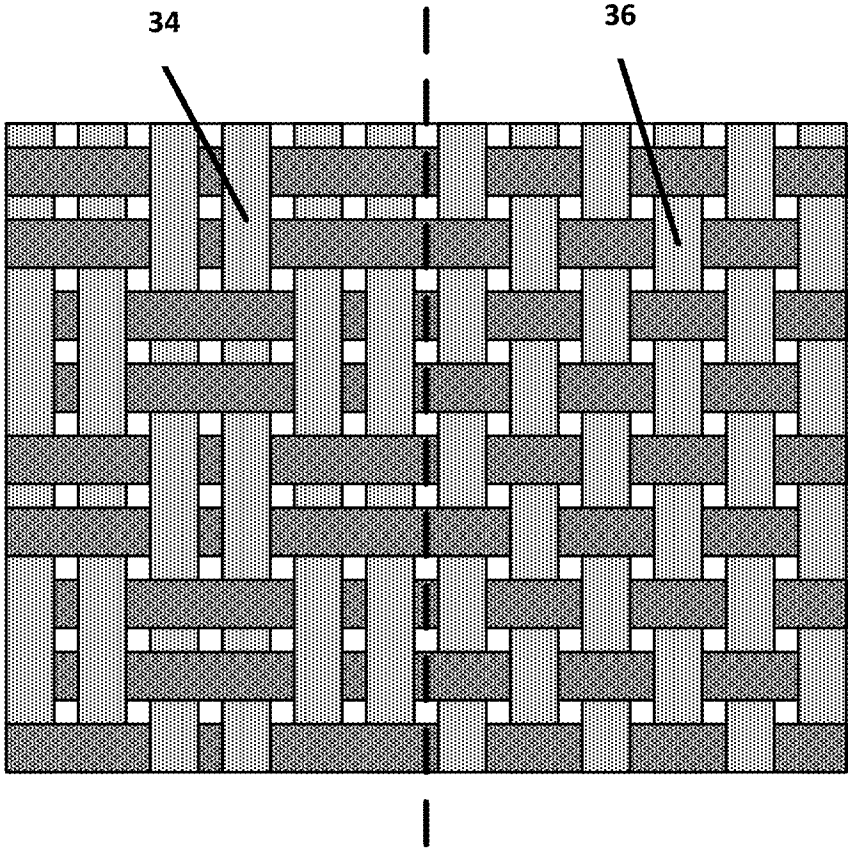
FIG. 8 illustrates an example of a basket weave adjacent a plain weave.

FIG. 3C illustrates another embodiment of a screened enclosure 32 that is mounted to an exterior portion of wall 28. In this embodiment, the screened enclosure is similar to the embodiment shown in FIG. 3A, but the visible marker 10 that defines the second transparency is configured from a basket weave, while the ground pattern 12 that defines the first transparency is configured from a plain weave. It should be appreciated that the first and second transparencies can be configured from any suitable combination of weave patterns. It should also be appreciated that three or more transparencies can be configured from any suitable combination of weave patterns as well. Alternatively, the two or more transparencies may be accomplished via printing a pattern on the screen 14. As just one of the many examples of combinations of weave patterns, FIG. 8 illustrates a close-up view of a basket weave 34 adjacent a plain weave 36. In this manner, configuring the two or more different weave patterns adjacent to one another can create a corresponding number of transparencies.

In the embodiments illustrated in FIGS. 3A-3C, the visible markers 10 may be configured to extend 2 inches (5.08 centimeters) in the second direction W. Furthermore, the center points along the second direction W, of the visible markers 10 may be repeated every 24 inches (60.96 centimeters) center-to-center along the second direction W. It should be appreciated that the visible markers 10 may extend any length along the second direction W, and may be spaced apart at any distance along the second direction W. It should also be appreciated that the visible markers 10 may be positioned perpendicular to the configuration as shown in FIGS. 3A-3C. In this manner, the visible markers 10 may extend along the first direction L, such that the visible markers 10 extend along the second direction W from one side of the screen 14 to the other side of the screen 14. In other embodiments, visible marker 10 may not be parallel to any surface of the frame. For example, visible marker 10 may be a diagonal line that extends along the third direction D, which is not parallel to first or second direction L or W. It should be appreciated that while FIGS. 3A-3C illustrate the third direction D as extending in one direction, third direction D may in fact extend in any direction along the 90° between first and second directions L and W.

It should be appreciated that in other embodiments, the visible markers 10 may extend any length less than 2 inches (5.08 centimeters) in either the first or second direction L or W. In other embodiments, the visible markers 10 may extend any length greater than 2 inches (5.08 centimeters) in either the first or second direction L or W. In this manner, the visible markers 10 may take on virtually any size. It should also be appreciated that the visible markers 10 may be repeated center-to-center any length less than 24 inches (60.96 centimeters). As well, in other embodiments, the visible markers may be repeated center-to-center any length greater than 24 inches (60.96 centimeters).

While the embodiments illustrated in FIGS. 3A-3C show the visible markers defining substantially straight lines that are substantially parallel to a side of the frame, it should also be appreciated that the visible markers 10 may be any size and/or shape and may be placed in any configuration and in any direction on screen 14. For example, in some embodiments the visible markers 10 are circles, squares, rectangles, triangles, stars, or any other shape. In some embodiments, the visible markers 10 are placed on screen 14 in a predictable pattern, while in other embodiments the visible markers 10 are randomly positioned on screen 14. In some embodiments, screen 14 may contain a combination of shapes and patterns for visible marker 10. For example, the screen 14 may be configured such that visible marker 10 comprises a straight line extending along any direction and a plurality of square shapes. In general, it should be appreciated that visible marker 10 may be configured to any size, shape, pattern, and combination shapes. Furthermore, visible marker 10 may be positioned at any location along screen 14 and may extend in any direction (L, W, or D).

Figure 4A:
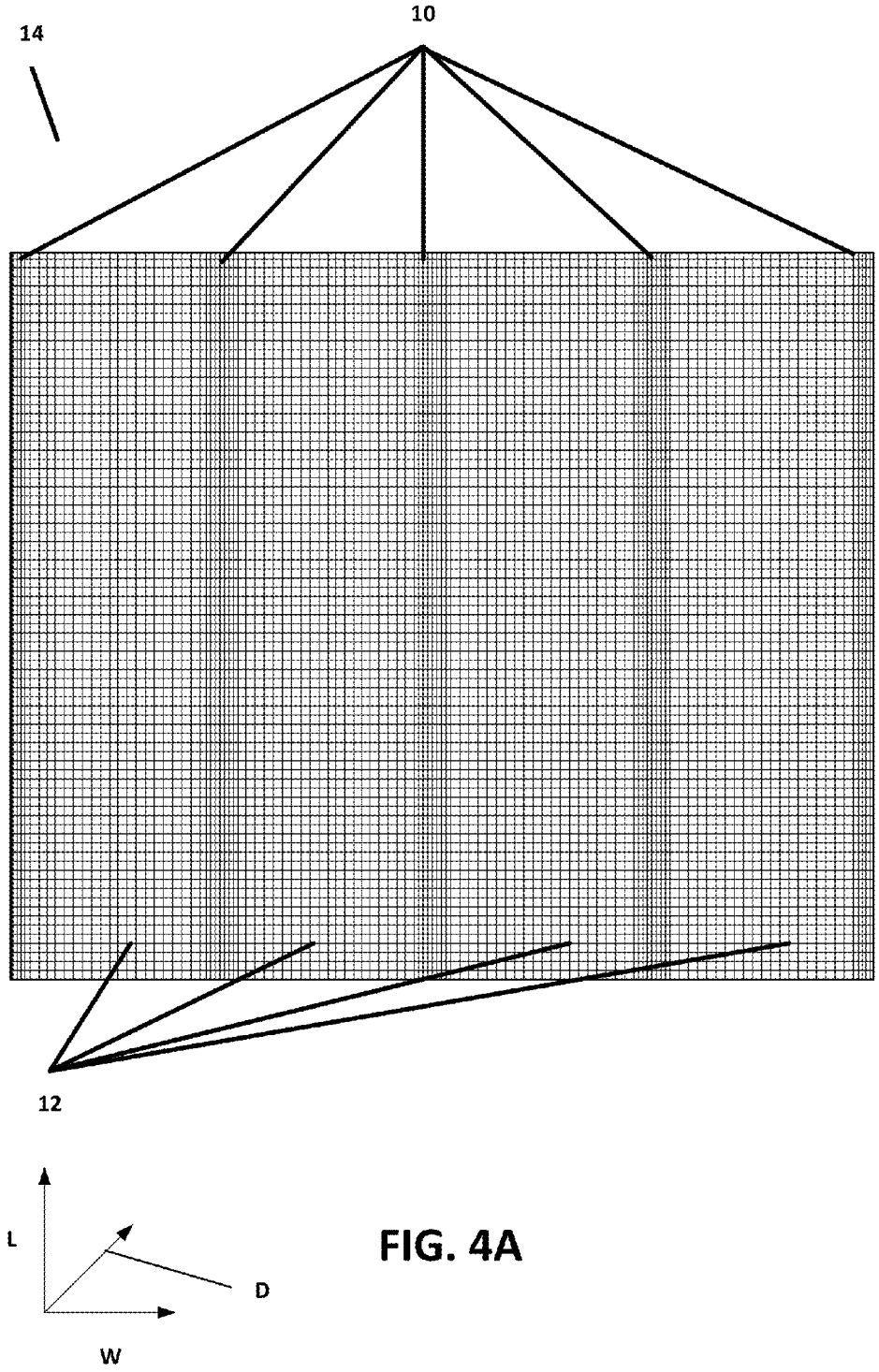
FIG. 4A illustrates a front-view of a screen with visible markers positioned at various locations on the screen.

FIG. 4A illustrates an embodiment of screen 14 with a plurality of visible markers 10. The embodiment shown in FIG. 4A further illustrates the screen 14 as illustrated in FIG. 3A, but further illustrates that screen 14 may be configured to any size, shape and may be configured to have any number, size, shape, and pattern of visible markers 10. For example, in some embodiments, screen 14 is a circle, square, rectangle, triangle, star, or any other shape. In addition, any of the various shapes of screen 14 may be configured to display any configuration of visible marker as previously discussed.

With specific reference to the embodiment illustrated in FIG. 4A, screen 14 may be constructed of a plain weave pattern and may measure 96 inches (243.84 centimeters) in the second direction W. Screen 14 may also define a mesh comprised of a vinyl coated fiberglass that measures 0.006 inches (0.01524 centimeters) to 0.011 inches (0.02794 centimeters) in diameter. In addition, warp threads 22 may have a fixed color throughout the entire pattern, such as black. The screen 14 in this embodiment may have variable ends/inch. In this manner, the ground pattern 12 that defines the first transparency may have 18 ends/inch (45.72 ends/inch), while the visible marker 10 that defines the second transparency may have 36 ends/inch (91.44 ends/inch). The visible markers 10 may measure 2 inches (5.08 centimeters) in width along the second direction W and may be spaced apart and repeated 24 inches (60.96 centimeters) center-to-center with respect to the next visible marker 10. The screen 14 may have 2,016 total ends (or warp threads 22), with the ground patterns 12 including 1,584 ends and the visible marker 10 patterns including 288 ends.

With continued reference to the embodiment illustrated in FIG. 4A, screen 14 may have also have filling threads 20 comprised of a vinyl coated fiberglass that measures 0.006 inches (0.01524 centimeters) to 0.011 inches (0.02794 centimeters) in diameter. In addition, filling threads 20 may also have a fixed color throughout the entire pattern, such as black. The screen 14 may also have 18 reeds and a variable reed plan of 1 end/dent in the ground patterns 12, and 2 ends/dent in the visible marker 10 patterns. In addition, the screen 14 may have 16 picks/inch (40.64 picks/inch). Furthermore, screen 14 may be finished with a heat/melt process in order to bind the threads and prevent slippage.

FIG. 4B illustrates a close-up view of the interface where visible marker 10 and ground pattern 12 abut. In the embodiment shown in FIG. 4B, the ratio of second and first transparency warp threads 22 to each other is 2:1. In other words, the density of the second transparency warp threads 22 may be 36 ends/inch (91.44 centimeters), while the density of the first transparency warp threads 22 may be 18 ends/inch (45.72 centimeters). The illustration in FIG. 4B is intended to more closely show the visible contrast between the first and second transparencies. However, it should be appreciated that any density and ratio of warp threads may be used such that it is capable of creating a first and a second transparency.

FIG. 5A illustrates an embodiment of screen 14 with a plurality of visible markers 10. The embodiment shown in FIG. 5A further illustrates the screen 14 as illustrated in FIG. 3B, but further illustrates that screen 14 may be configured to any size, shape and may be configured to have any number, size, shape, and pattern of visible markers 10. For example, in some embodiments, screen 14 is a circle, square, rectangle, triangle, star, or any other shape. In addition, any of the various shapes of screen 14 may be configured to display any configuration of visible marker as previously discussed.

With specific reference to the embodiment illustrated in FIG. 5A, screen 14 may be constructed of a plain weave pattern that may measure 96 inches (243.84 centimeters) in the second direction W. Screen 14 may also have warp threads 22 comprised of a vinyl coated fiberglass that measures 0.006 inches (0.01524 centimeters) to 0.011 inches (0.02794 centimeters) in diameter. The warp threads may have a variable color pattern. In this manner, the warp threads 22 may be black in the ground pattern 12 and white in the visible marker 10 pattern (and/or any suitable combination of light values). The screen 14 in this embodiment may have fixed ends/inch of 18 ends/inch (45.72 ends/centimeter) in both the ground pattern 12 that defines the first transparency and the visible marker 10 that defines the second transparency. The visible marker 10 may measure 2 inches (5.08 centimeters) in width along the second direction W and be spaced apart 24 inches (60.96 centimeters) center-to-center with respect to the next visible marker 10 along the second direction W.

With continued reference to the embodiment illustrated in FIG. 5A, screen 14 may have also have filling threads 20 comprised of a vinyl coated fiberglass that measures 0.006 inches (0.01524 centimeters) to 0.011 inches (0.02794 centimeters) in diameter. In addition, filling threads 20 may have a fixed throughout the entire pattern, such as black. The screen 14 may have 18 reeds and a fixed reed plan of 1 end/dent in both the ground patterns 12 and the visible marker 10 patterns. In addition, the screen 14 may have 16 picks/inch (40.64 picks/inch). Furthermore, screen 14 may be finished with a heat/melt process in order to bind the threads and prevent slippage.

Figure 5B:
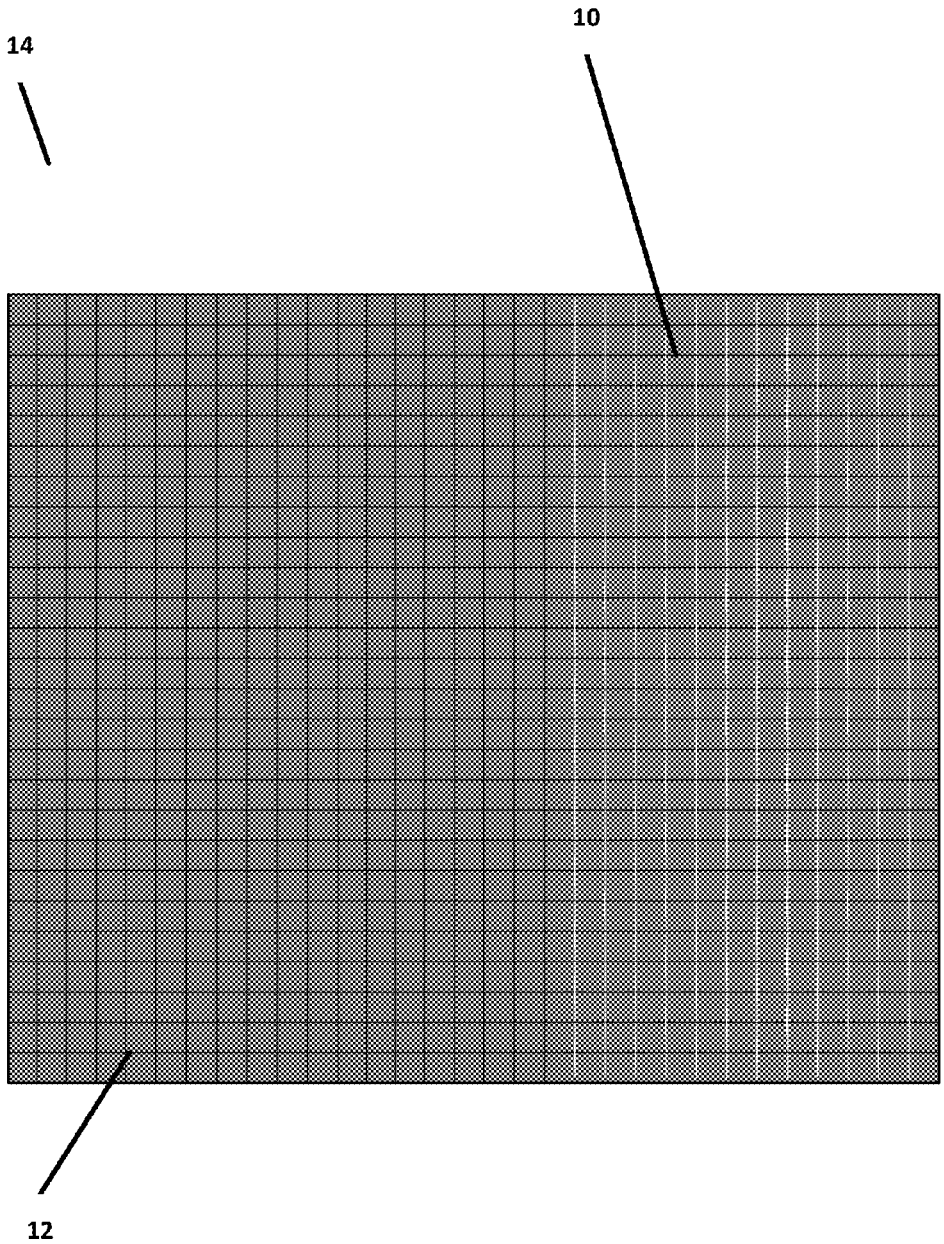
FIG. 5B illustrates a close-up view of the screen from FIG. 5A focusing on the visible marker abutting a ground pattern.
Figure 5B:
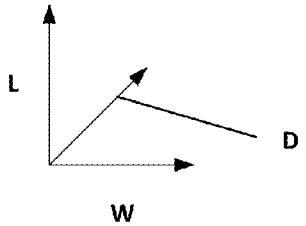

FIG. 5B illustrates a close-up view of the interface where visible marker 10 and ground pattern 12 abut. In the embodiment shown in FIG. 5B, the ratio of second and first transparency warp threads 22 to each other is 1:1. In order to create visible marker 10, which defines the second transparency, the longitudinal threads that run along the first direction L within visible marker 10 may be white in color. In effect, this is similar to the embodiment shown in FIG. 3B where the visible markers 10 are configured from warp threads 22 that are white in color. The illustration in FIG. 5B is intended to more closely show the visible contrast between the first and second transparencies. However, it should be appreciated that any density and ratio of warp threads 22 may be used in either the first and/or second transparency. Furthermore, it should also be appreciated that any color or combination of colors of warp threads 22 may be used to create the first and second transparencies, such that the two colors are capable of creating a first and second transparency.

Figure 6A:
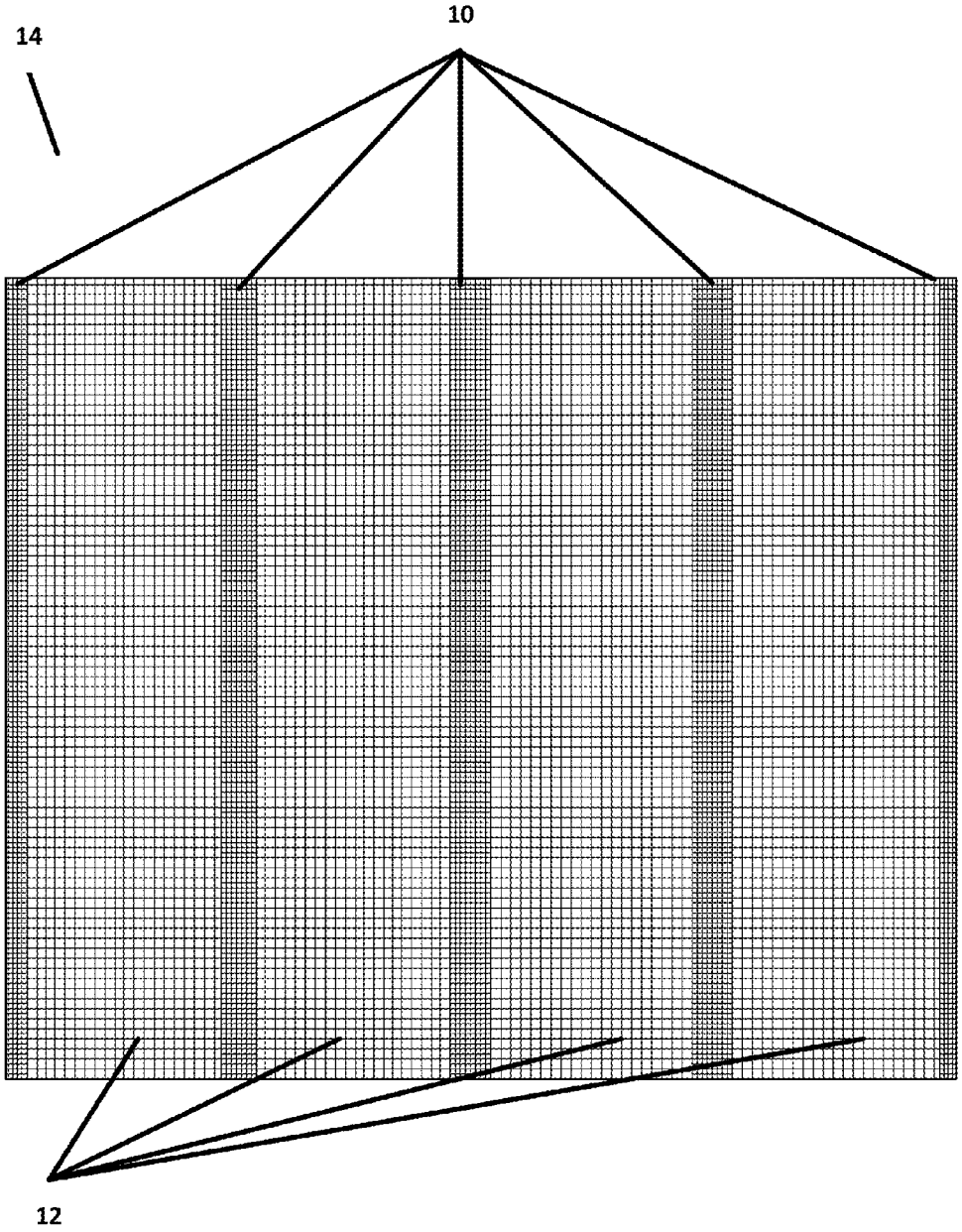
FIG. 6A illustrates a front-view of a screen with visible markers positioned at various locations on the screen.
Figure 6A:
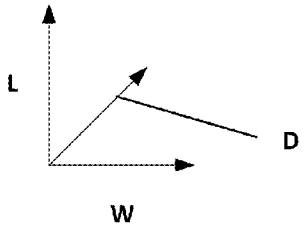

FIG. 6A illustrates an embodiment of screen 14 with a plurality of visible markers 10. The embodiment shown in FIG. 6A further illustrates the screen 14 as illustrated in FIG. 3C, and further illustrates that screen 14 may be configured to have any number, size, shape, and combination of weave patterns in the ground pattern 12 and visible markers 10. For example, in some embodiments, screen 14 is a circle, square, rectangle, triangle, star, or any other shape or repeating pattern. In addition, any of the various shapes of screen 14 may be configured to display any configuration of visible marker as previously discussed.

With specific reference to the embodiment illustrated in FIG. 6A, screen 14 may be constructed of a basket weave pattern and a plain weave pattern. In one embodiment, screen 14 may measure 96 inches (243.84 centimeters) in the second direction W. Screen 14 may also define a mesh comprised of a vinyl coated fiberglass that measures 0.006 inches (0.01524 centimeters) to 0.011 inches (0.02794 centimeters) in diameter. In FIG. 6A, the ground pattern 12 can be constructed of a plain weave and the visible markers 10 can be constructed of a basket weave. In addition, warp threads 22 may have a fixed color throughout the entire pattern, such as black. The screen 14 in this embodiment may have variable ends/inch. In this manner, the ground pattern 12 that defines the first transparency may have 18 ends/inch (45.72 ends/inch), while the visible marker 10 that defines the second transparency may have 36 ends/inch (91.44 ends/inch). The visible markers 10 may measure 2 inches (5.08 centimeters) in width along the second direction W and may be spaced apart and repeated 24 inches (60.96 centimeters) center-to-center with respect to the next visible marker 10. The screen 14 may have 2,016 total ends (or warp threads 22), with the ground patterns 12 including 1,584 ends and the visible marker 10 patterns including 288 ends.

The example in FIG. 6A illustrates that the ground pattern 12 is a plain weave, and the visible markers 10 are a basket weave, yet any weave pattern can be used for the ground pattern 12 and the visible markers 10. For example, the ground pattern 12 could be a basket weave, and the visible markers could be a plain weave. In another example, the ground pattern 12 could be a basket weave, and the visible markers could be a crepe weave. It should be appreciated that the ground pattern 12 and the visible markers 10 can be configured of any weave patterns and combination of weave patterns. In this manner, different weave patterns can visually appear differently from one another, which can in effect be used in combination to achieve two or more transparencies.

With continued reference to FIG. 6A, in another embodiment, screen 14 may have also have filling threads 20 comprised of a vinyl coated fiberglass that measures 0.006 inches (0.01524 centimeters) to 0.011 inches (0.02794 centimeters) in diameter. In addition, filling threads 20 may also have a fixed color throughout the entire pattern, such as black. The screen 14 may also have 18 reeds and a variable reed plan of 1 end/dent in the ground patterns 12, and 2 ends/dent in the visible marker 10 patterns. In addition, the screen 14 may have 16 picks/inch (40.64 picks/inch). Furthermore, screen 14 may be finished with a heat/melt process in order to bind the threads and prevent slippage.

Figure 6B:
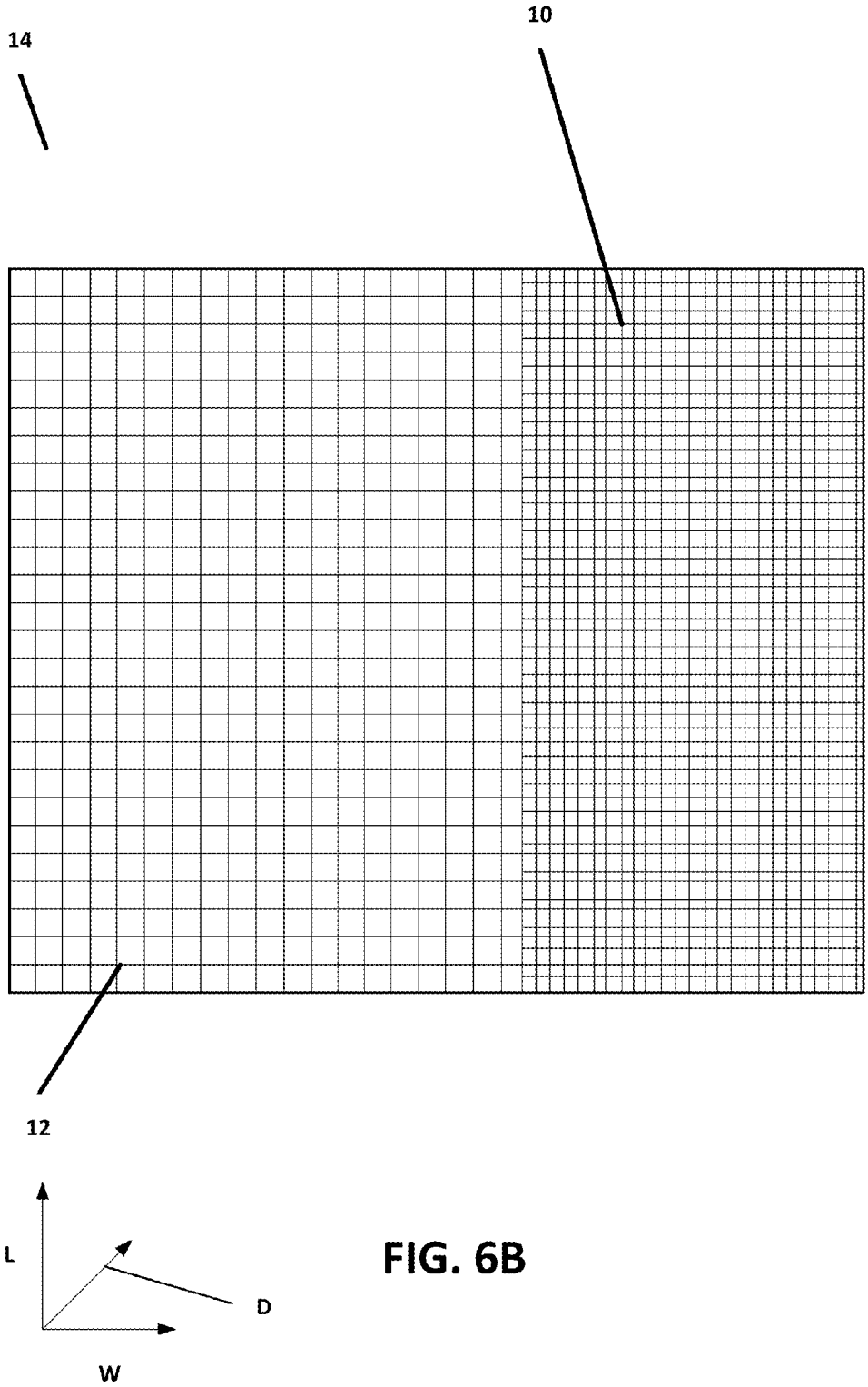
FIG. 6B illustrates a close-up view of the screen from FIG. 6A focusing on the visible marker abutting a ground pattern.

FIG. 6B illustrates a close-up view of the interface where visible marker 10 and ground pattern 12 abut. In the embodiment shown in FIG. 6B, the ratio of second and first transparency warp threads 22 to each other is 2:1. In other words, the density of the second transparency warp threads 22 may be 36 ends/inch (91.44 centimeters), while the density of the first transparency warp threads 22 may be 18 ends/inch (45.72 centimeters). The illustration in FIG. 6B is intended to more closely show the visible contrast between the first and second transparencies as a result of using different weave patterns. However, it should be appreciated that any weave patterns, combination of weave patterns, and density and ratio of warp threads may be used such that it are capable of creating a first and a second transparency. For example, FIG. 8 illustrates a close-up view of a basket weave 34 adjacent a plain weave 36. In this manner, configuring the two or more different weave patterns adjacent one another can create a corresponding number of transparencies that can be visually detected by the user.

It should be appreciated that FIGS. 4A-4B, 5A-5B and 6A-6B illustrate just a few embodiments of screen 14, and that any of the features and dimensions previously discussed may be altered or omitted such that it produces a screen that is capable of displaying a first and second transparency. For example, in some embodiments the screen 14 may extend any length less than 96 inches (243.84 centimeters) in either the first or second direction L or W. In other embodiments, the screen 14 may extend any length greater than 96 inches (243.84 centimeters) in either the first or second direction L or W. It should also be appreciated that the screen 14 may be configured to have any combination of dimensions less than or greater than 96 inches (243.84 centimeters). For example, the screen 14 may extend any length greater than 96 inches (243.84 centimeters) in the first direction L and may extend any width less than 96 inches (243.84 centimeters) in the second direction W. In other embodiments, the screen 14 may extend any length less than 96 inches (243.84 centimeters) in the first direction L and may extend any width greater than 96 inches (243.84 centimeters) in the second direction W. It should also be appreciated that in any of the embodiments previously described, the two or more transparencies may be also accomplished via printing a pattern on the screen 14.

While the aforementioned discussion has described the second transparency as having increased visible detectability with respect to the first transparency, it should also be appreciated that the amount of transparency of the first and second transparencies may be reversed. In this manner, the second transparency has decreased visible detectability with respect to the first transparency, and the first transparency has increased visible detectability with respect to the second transparency. In other words, the second transparency is less visible with respect to the first transparency.

It should also be appreciated that the screen 14 may include three or more different transparencies. For example, the first transparency may have a first level of visible detectability, the second transparency may have a second level of visible detectability, and the third transparency may have a third level of visible detectability. It should be noted that the first, second, and third levels of visible detectability may all be different with respect to each other. The three or more transparencies may be created by any combination of the density and thread colors as previously described. In effect, the screen 14 may be configured to achieve any level of visible detectability required by the application. In other words, the screen 14 may be configured to be customized to meet the requirements of any specific application. Furthermore, it should be appreciated that any of the variations in size, shape, color, pattern, material type, etc. as discussed above also applies to the embodiments of the screen 14 that display three or more different transparencies.

Figure 7:
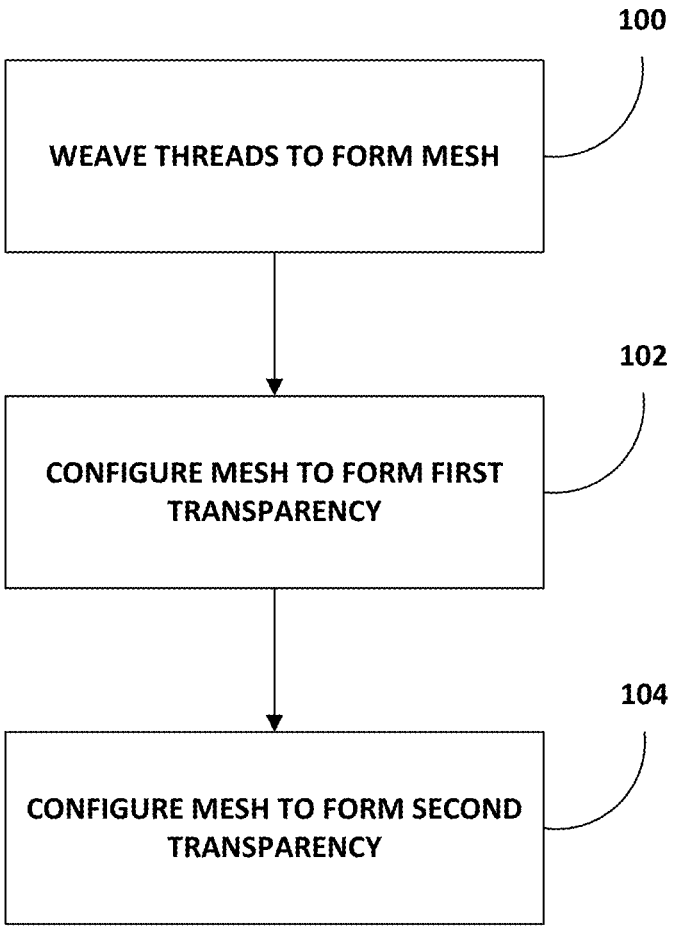
FIG. 7 illustrates a flow-chart showing a method for manufacturing a screen with visible markers.

FIG. 7 illustrates a method of manufacturing the screen 14 with a first and second transparency. The screen 14 includes a longitudinal thread that extends along a first direction L and a widthwise thread that extends along a second direction W. The second direction W is perpendicular to the first direction L. The method includes the steps of weaving the longitudinal thread and the widthwise thread to form a mesh. The method further includes configuring the mesh to form a first pattern configured to achieve a first transparency and a second pattern configured to achieve a second transparency. The first and second transparencies may be configured such that the screen 14 is configured to display a visible marker alerting the user that the screen 14 is present. The structure recited in this method may embody any variation of the structural elements previously discussed. It should also be appreciated that the method may be used to configure any of the various embodiments of the screen 14 as previously discussed in this disclosure.

The various features and processes described above may be used independently of one another, or may be combined in various ways. All possible combinations and subcombinations are intended to fall within the scope of this disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed embodiments. The example systems and components described herein may be configured differently than described. For example, elements may be added to, removed from or rearranged compared to the disclosed examples.

Conditional language used herein, such as, among others, "can," "could," "might," 'may," "e.g.," and the like, unless specifically stated otherwise, or otherwise understood within the context as used, is generally intended to convey that certain examples include, while other embodiments do not include, certain features, elements, and/or steps. Thus, such conditional language is not generally intended to imply that features, elements, and/or steps are in any way required for one or more examples or that one or more examples necessarily include logic for deciding, with or without author input or prompting, whether these features, elements, and/or steps are included or are to be performed in any particular example. The terms "comprising," "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some or all of the elements in the list.

While certain example embodiments have been described, these embodiments have been presented by way of example only, and are not intended to limit the scope of the inventions disclosed herein. Thus, nothing in the foregoing description is intended to imply that any particular feature, characteristic, step, module, or block is necessary or indispensable. Indeed, the novel methods and systems described herein may be embodied in a variety of other forms; furthermore, various omissions, substitutions and changes in the form of the methods and systems described herein may be made without departing from the spirit of the inventions disclosed herein. The accompanying claims and their equivalents are intended to cover such forms or modifications as would fall within the scope and spirit of certain of the inventions disclosed herein.

What is claimed:

1. A screen product comprising:

a screen configured to be removably received by a frame, the screen comprising:

a plurality of longitudinal threads that extend along a first direction; and a plurality of widthwise threads that extend along a second direction that is perpendicular to the first direction, wherein the longitudinal threads and the widthwise threads are weaved to form a mesh that includes a first pattern configured to achieve a first transparency, and wherein the mesh includes a second pattern that is different from the first pattern and configured to achieve a second transparency that is different from the first transparency;

wherein the first and second transparencies are operable to produce a visually perceptible difference between the first and second transparencies when the screen product is viewed; and wherein the screen product is configured to be used in a door or window opening to provide a visible indication of presence of the screen product due to differences in light attenuation by the first and second transparencies and not due to color or hue of the screen product.

2. The screen product of claim 1, wherein the screen includes additional patterns that are different from the first pattern and configured to achieve additional transparencies that are different from the first transparency.

3. The screen product of claim 1, wherein the second transparency is situated to generate a visible contrast when positioned adjacent to the first transparency, and wherein the first and second transparencies are vertical patterns that are repeated in a horizontal direction.

4. A screen product comprising:

a screen configured to be removably received by a frame, the screen comprising:

a plurality of longitudinal threads that extend along a first direction; and a plurality of widthwise threads that extend along a second direction that is perpendicular to the first direction;

wherein the longitudinal threads and the widthwise threads are configured to achieve a first transparency and a second transparency that is different from the first transparency;

wherein the first and second transparencies are operable to produce a visually perceptible difference between the first and second transparencies when the screen product is viewed; and wherein the screen product is configured to be used in a door or window opening to provide a visible indication of presence of the screen product due to differences in light attenuation by the first and second transparencies and not due to color or hue of the screen product.

5. The screen product of claim 4, wherein the first transparency is defined by a number of longitudinal threads per inch, and wherein the density of the second transparency is different than the density of the first transparency.

6. The screen product of claim 4, wherein the longitudinal threads and the widthwise threads are made from a material selected from the group consisting of stainless steel, vinyl coated fiberglass yarn, and fiberglass, and wherein the longitudinal threads and widthwise threads are 0.006 inches to 0.011 inches in diameter.

* * * * *